US005259216A

United States Patent [19]

Zorini

[11] Patent Number: 5,259,216

[45] Date of Patent: Nov. 9, 1993

[54] ACTUATOR DEVICE FOR TRANSMITTING HORIZONTAL OSCILLATORY MOVEMENTS TO TUBE BARS IN KNITTING MACHINES

[76] Inventor: Luigi O. Zorini, Comez S.p.A. Via Enrico Fermi 5, 27024 Cilavegna (Pavio), Italy

[21] Appl. No.: 905,001

[22] Filed: Jun. 26, 1992

[30] Foreign Application Priority Data

Sep. 16, 1991 [IT] Italy ..... MI91A002439
Apr. 13, 1992 [IT] Italy ..... MI92A000895

[51] Int. Cl.[5] ..... D04B 27/26

[52] U.S. Cl. ..... 66/233; 66/85 A; 66/242; 66/205; 112/80.23

[58] Field of Search ..... 66/83, 84 A, 85 R, 85 A, 66/204, 205, 214, 231, 237, 233, 242; 139/55.1; 112/80.23, 80.7

[56] References Cited

U.S. PATENT DOCUMENTS 3,722,434 3/1973 Strother et al. ..... 112/80.23
3,762,184 10/1973 Schur et al. ..... 66/205
3,978,690 9/1976 Beling et al. ..... 66/205
4,092,838 6/1978 Gangi ..... 66/214
4,109,593 8/1978 Barnes et al. ..... 112/80.23 X
4,314,463 2/1982 Fuchs ..... 66/204 X
4,344,307 8/1982 Bucher et al. ..... 66/84 R
4,761,973 8/1988 Gangi ..... 66/204
4,989,423 2/1991 Schäfer ..... 66/204

*Primary Examiner*—Clifford D. Crowder
*Assistant Examiner*—John J. Calvert
*Attorney, Agent, or Firm*—Laff, Whitesel, Conte & Saret

[57] ABSTRACT

In a knitting machine, a plurality of stepping motors (10) is controlled by an electronic control unit (35) and each motor transmits horizontal oscillations to a tube bar (5). Each oscillation is built up of a plurality of horizontal-movement steps, each step being delimited between two limit points to which a centered positioning of the threading tubes (8) in the spaces defined between the needles (9) corresponds. A photoelectric sensor interlocked to the control unit detects the passage before a given read point of optical locators reproduced on plate-like elements, each associated with the drive shaft of one of the motors, in order to check whether the individual bars perform correct movements. Should a cutoff in the electric supply to the knitting machine (4) occur, each tube bar (5) would be stopped at anyone of the limit points.

17 Claims, 5 Drawing Sheets

| Position | Angular Steps | Angle α | Obtainable Displacement | Rated Displacement |
|---|---|---|---|---|
| 0 | 0 | 0 | 0 | 0 |
| a | 12 | 5.4° | 1.665 | 1.7 |
| b | 24 | 10.8° | 3.403 | 3.4 |
| c | 35 | 15.75° | 5.063 | 5.1 |
| d | 46 | 20.7° | 6.751 | 6.8 |
| e | 57 | 25.65° | 8.470 | 8.5 |
| f | 68 | 30.6° | 10.196 | 10.2 |
| g | 79 | 35.55° | 11.921 | 11.9 |
| h | 90 | 40.5° | 13.631 | 13.6 |
| i | 101 | 45.45° | 15.314 | 15.3 |
| l | 112 | 50.4° | 16.949 | 17 |
| m | 124 | 55.8° | 18.696 | 18.7 |
| n | 136 | 61.2° | 20.361 | 20.4 |

ACTUATOR DEVICE FOR TRANSMITTING HORIZONTAL OSCILLATORY MOVEMENTS TO TUBE BARS IN KNITTING MACHINES

BACKGROUND OF THE INVENTION

1. Field of the Invention

The present invention relates to an actuator device for transmitting horizontal oscillatory movements to tube bars in knitting machines, said tube bars being supported, at the respective opposite ends, by at least two lifting plates slidably engaging them in a horizontal direction, said device comprising: a supporting framework rigidly connected to a base of said knitting machine; a plurality of movement rods each exhibiting one end operatively connected to one end of a corresponding tube bar; drive means acting on a second end of each movement rod opposite to said first end, for transmitting a horizontal oscillatory movement of variable amplitude to the corresponding tube bar, said horizontal oscillatory movement being combined with a vertical oscillatory movement imparted to the tube bars through said lifting plates, in order to give a plurality of threading tubes engaged to the tube bars a reciprocating motion according to a curved path extending astride of respective needles disposed consecutively in side by side relation, so as to cause the interlacing of the weft yarns with the warp yarns guided to the needles.

2. Prior Art

It is known that in knitting machines in general, and more particularly in crochet gallon looms the production of a manufactured article takes place through interlacing of weft yarns with warp yarns carried out at a plurality of needles disposed parallelly in side by side relation and spaced apart a given distance from each other on a front bar, and simultaneously operated in rectilinear reciprocating motion in a longitudinal direction. The warp yarns are engaged to respective eye-pointed needles located in front of the needles and driven in reciprocating motion according to a curved path astride of one or more of the needles themselves.

The weft yarns, in turn, are individually guided in respective threading tubes disposed mutually in side by side relation and distributed along one or more tube bars that are driven in reciprocating motion in such a manner that each threading tube travels along a curved path extending astride of one or more needles.

The above movement is achieved through the combination of a vertical reciprocating motion with a horizontal reciprocating motion.

The vertical reciprocating motion takes place by means of a pair of kinematic mechanisms consisting of a connecting rod-crank assembly driven by the main drive shaft of the machine and acting upon two support plates slidably guided in a vertical direction at the upper part of the base. Each of these plates is slidably passed through by the individual tube bars, at one of the ends thereof. Therefore all tube bars are simultaneously concerned with vertical movements, which movements perform a constant stroke.

On the contrary, as regards the horizontal movement, the individual tube bars are driven independently of one another, and the amplitude of the strokes thereof is varying each time, depending upon the number of needles that are to be each time stepped over by the threading tubes in order to achieve the desired pattern on the manufactured article being worked. To this end, the individual tube bars are connected, via movement rods engaging them at one of their ends, to corresponding drive members oscillatably linked to a fixed framework and designed to be activated by the so-called "glider chains".

Each glider chain is comprised of a plurality of cam elements, mutually linked one after the other so as to form a true chain extending in a closed loop. The individual chains are engaged on respective drive wheels disposed mutually in side by side relation close to said drive members and simultaneously driven in rotation such that the individual cam elements, against the action of return springs acting on the tube bars, give rise to reciprocating oscillations of the corresponding drive members of a variable amplitude depending on the geometric conformation of the cam elements. Corresponding to the oscillations of the individual drive members are horizontal oscillations of the respective tube bars.

It is to be pointed out in fact that each group of chains is suited for working one type only of manufactured article. It results therefrom that it is generally necessary to replace all glider chains present in the knitting machine each time the type of product being worked needs to be changed.

In addition to this requirement that by itself involves important labor times, generally there is also the problem that difficult operations are to be accomplished manually for assembling the individual cam elements so as to form the glider chains to be used for the new working. These assembling operations are very long in that, above all in case of rather complicated manufactured articles, each chain may need to be formed even with different hundreds of cam elements that must be selected one by one and linked together following a precise order depending upon the pattern to be formed on the manufactured article.

Furthermore, chains dismantled from the knitting machine must be generally taken to pieces in order to make the individual cam elements available for making new chains.

Therefore an important problem is also represented by the high costs for setting up a knitting machine, above all when small samples of the manufactured articles are needed.

Also of great importance are costs for purchasing the very great amount of cam elements necessary to make said chains. Further expenses arise from the necessity of having true stocks of said cam elements at one's disposal. Actually the cam elements stocked in a warehouse need to be classified based on their geometric configuration and stored in an orderly manner for the purpose of making them readily available.

Glider chains also exhibit limitations as regards their technical features. In particular, difficulties are encountered when the tube bars must carry out horizontal oscillations of relatively wide amplitude, so that the threading tubes can move astride of a plurality of needles. In fact the amplitude of stroke imparted to each tube bar depends on the lifting detectable in the cam element producing it. On the other hand, the use of cam elements having a lifting greater than given values would involve overstresses on the structures and driving mechanisms of the knitting machine, also resulting from the necessity of overloading the return springs in order to ensure constant contact of the drive members with the cam elements, above all at high operating speeds.

SUMMARY OF THE INVENTION

The main object of the present invention is to eliminate the problems of the known art by providing an actuator device capable of causing the horizontal movement of the individual tube bars to be executed according to any desired operating sequence, and enabling the movements of the bars to be adapted at any time to different types of working, without requiring the replacement of any mechanical elements in the knitting machine.

The foregoing and further objects that will become more apparent in the following description, are substantially attained by an actuator device for transmitting horizontal oscillatory movements to tube bars in knitting machines, in accordance with the present invention, wherein said drive means comprises: a plurality of electric stepping motors fastened to the supporting framework and each arranged to impart to a respective drive shaft angular rotations caused by a succession of angular steps of predetermined breadth; a plurality of kinematic transmission mechanisms each of which connects one of the movement rods to the drive shaft of one of said stepping motors, for transmitting a horizontal displacement to the corresponding tube bar as a result of an angular rotation of the drive shaft itself; at least one electronic control unit controlling the actuation of the individual stepping motors in order to transmit the individual tube bars horizontal oscillations the amplitude of which is caused by a sequence of horizontal-movement steps, each of which corresponds to a predetermined number of said angular steps and is defined by limit points to each of which a centered positioning of the threading tubes with respect to the spaces defined between said needles, corresponds.

BRIEF DESCRIPTION OF THE DRAWINGS

Further features and advantages will be better understood from the detailed description of a preferred embodiment of an actuator device for transmitting horizontal oscillatory movements to tube bars in knitting machines, in accordance with the present invention, given hereinafter by way of non-limiting example with reference to the accompanying drawings, in which.

DESCRIPTION OF THE PREFERRED EMBODIMENT

Figure 1:
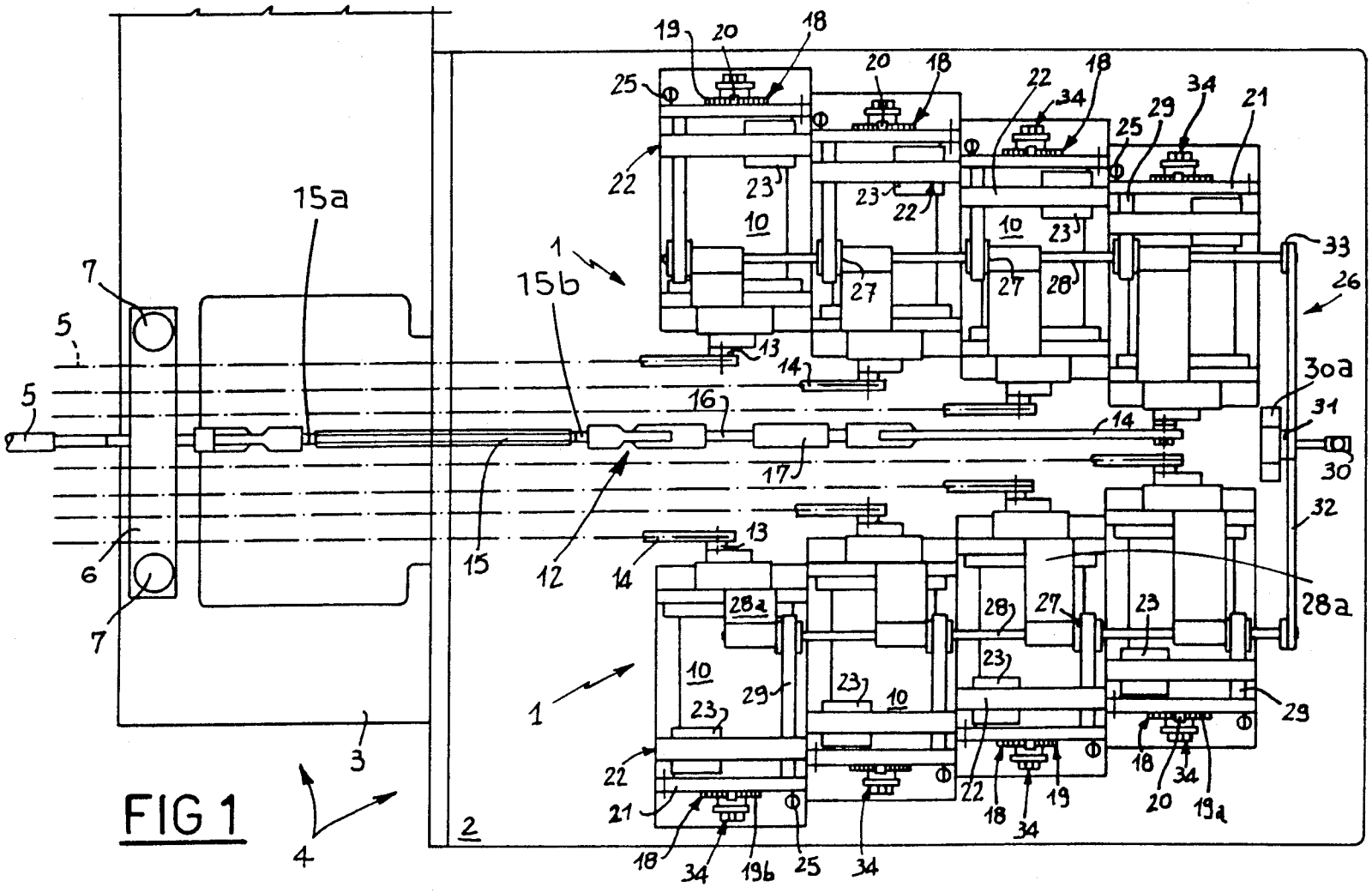
FIG. 1 is a diagrammatic top view of an actuator device in accordance with the present invention.
Figure 2:
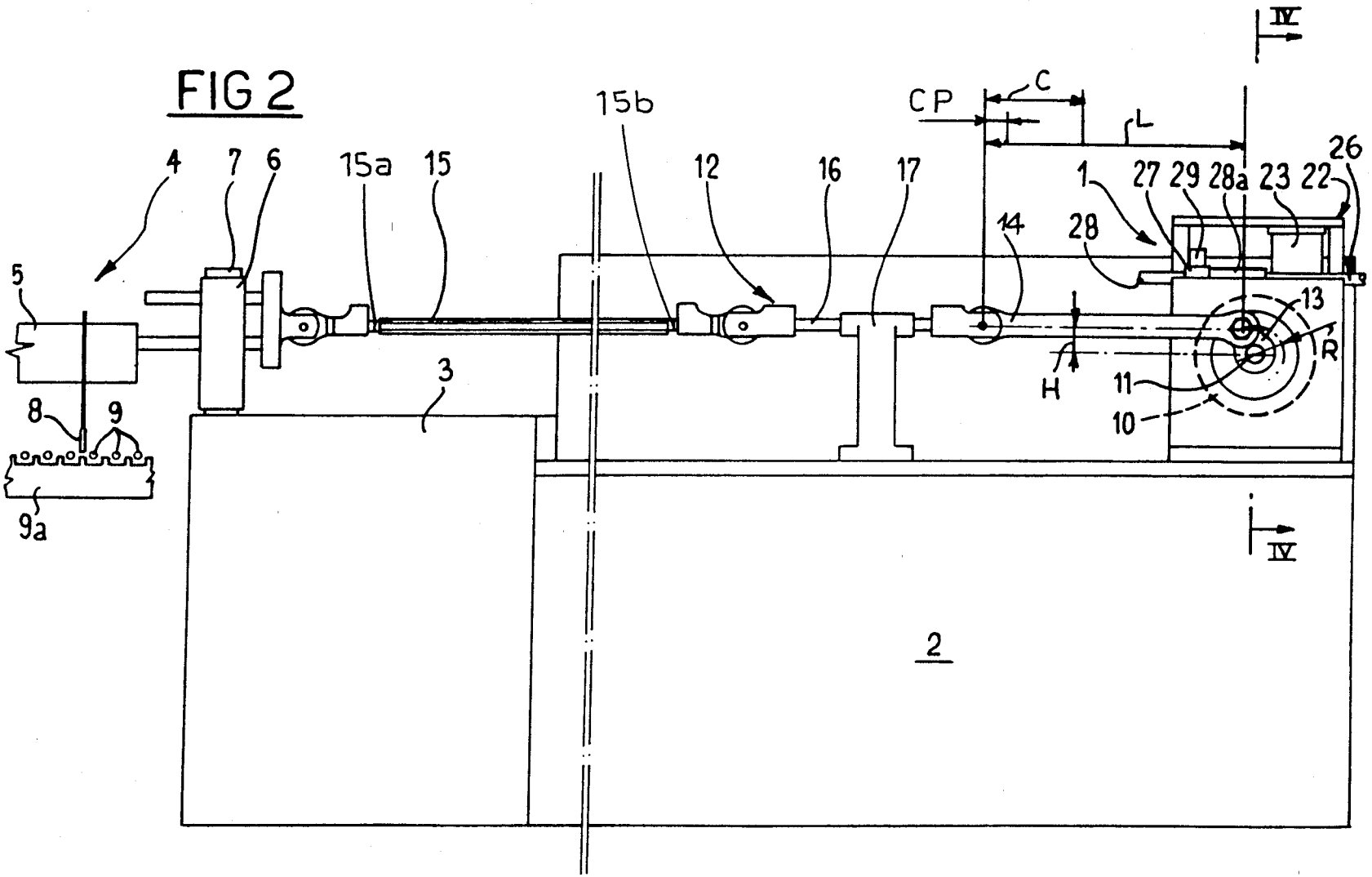
FIG. 2 is a diagrammatic side view showing the main members of the device in question, arranged to operate a single tube bar.

Referring particularly to FIGS. 1 and 2, an actuator device for transmitting horizontal oscillatory movements to tube bars in knitting machines, in accordance with the present invention, has been generally identified by reference numeral 1.

The device 1 lends itself to be mounted on a supporting framework 2 integral with the base 3 of a knitting machine, and more particularly a crochet galloon loom 4, and is arranged to act on one or more tube bars 5, only one of which is shown, in order to cause a reciprocating motion in a horizontal direction of said tube bars, as more clearly specified in the following.

In known manner, the tube bars 5 carry a plurality of threading tubes 8, engaging respective weft yarns (non shown) and are operatively supported at respective opposite ends thereof, by at least two lifting plates 6, only one of which is shown, slidably engaging the tube bars according to a horizontal direction coincident with the lengthwise extension of the tube bars. Each lifting plate 6 is slidably guided in a vertical direction on a pair of guide rails 7 integral with the base 3 of the knitting machine 4 and they are simultaneously driven in reciprocating motion along the rails themselves by a driving mechanism consisting of a connecting rod-crank assembly housed in the base and not shown as known per se and conventional.

The combination of the vertical oscillatory motion and the horizontal oscillatory motion imparted to each tube bar 5 is such that the threading tubes 8 engaged thereto are set in reciprocating motion according to a substantially arcuated path, stepping over one or more needless 9 disposed a given distance apart from one another, on a front bar 9*a* integral with the base 3 of the knitting machine 4. Following this reciprocating motion the weft yarns engaged through the threading tubes 8 are suitably interlaced with the warp yarns, in turn guided in respective eye-pointed needles (not shown as known per se) so as to cause the knitting of the manufactured article.

All that being stated, the device 1 of the invention provides for the presence of a plurality of driving rods 15, each of which has one end 15*a* operatively connected to one end of one of the bars 5, as well as a second end 15*b* connected to drive means adapted to transmit the desired movements to the tube bar 5.

In an original manner, this drive means comprises a plurality of electric stepping motors 10 fastened by respective support brackets 10*a* to the supporting framework 2. Each stepping motor 10, known per se and conventional, is adapted to drive in rotation a respective drive shaft 11 according to angular rotations each of which is comprised of a plurality of angular steps in succession having each a predetermined angular breadth.

The drive shaft 11 of each stepping motor 10 is operatively connected to one of the driving rods 15 by a kinematic transmission mechanism 12 arranged to transmit horizontal movements to the corresponding tube bar 5, following the angular rotation imparted to the drive shaft. This kinematic transmission mechanism 12 preferably consists of a crank 13 fixedly fitted on the drive shaft 11 and operatively engaged to a connecting rod 14 connected to the driving rod 15.

As can be seen in FIG. 1, the stepping motors 10 are preferably distributed in a horizontal plane so as to form two rows disposed opposite each other in mirror image relationship and diverging according to a V-shaped configuration the vertex of which faces away from the tube bars 5. This configuration enables an efficient reduction in the bulkiness of the device 1, keeping the connecting rods 14 disposed respectively in side by side relation within the space defined by the "V" formed with the assembly of motors 10.

It is to be noted that the distance differences between the closest and farthest motors 10 with respect to the tube bars 5 is compensated for by a corresponding difference in length between the driving rods 15 respectively belonging to said motors 10, the connecting rods 14 preferably being of same length "L" for all stepping motors 10.

In order to prevent the occurrence of too strong dynamic stresses on the kinematic transmission mechanism 12, the connection between each connecting rod 14 and the respective driving rod 15 may advantageously take place by means of a connecting stem 16 slidably guided in a horizontal direction parallel to the movements of the tube bars 5, on a guide support 17 fastened to the framework 11.

Still for the purpose of giving the device 1 an appropriate resistance to dynamic stresses it is also provided that each crank 13 be fitted on the corresponding drive shaft 11 by means of a cylindrical sleeve 13*a* which, upon interposition of a rolling bearing 13*b* disposed adjacent the crank 13, is rotatably engaged to the inside of a support collar 10*b* rigidly connected to the support bracket 10*a*, on the opposite side with respect to motor 10.

In accordance with the present invention, the stepping motors 10 are connected to a programmable electronic control unit 35 actuating them independently of each other, based on a previously inputted work program containing all data relating to the formation of a manufactured article having a specific pattern or embroidery.

Figure 3:
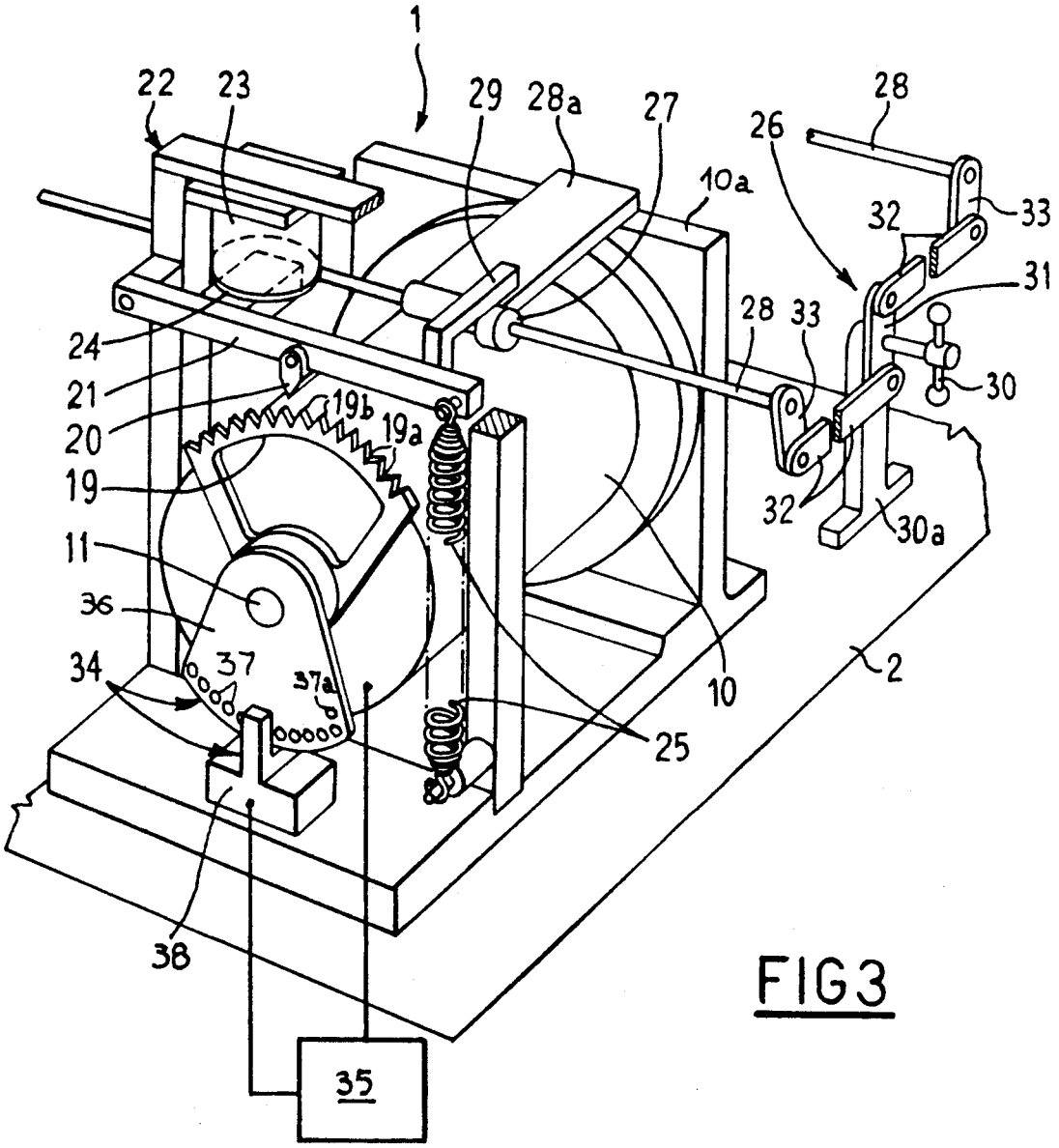
FIG. 3 is a perspective view in more detail of the control means and stop means combined with a stepping motor provided in the device in question.
Figure 4:
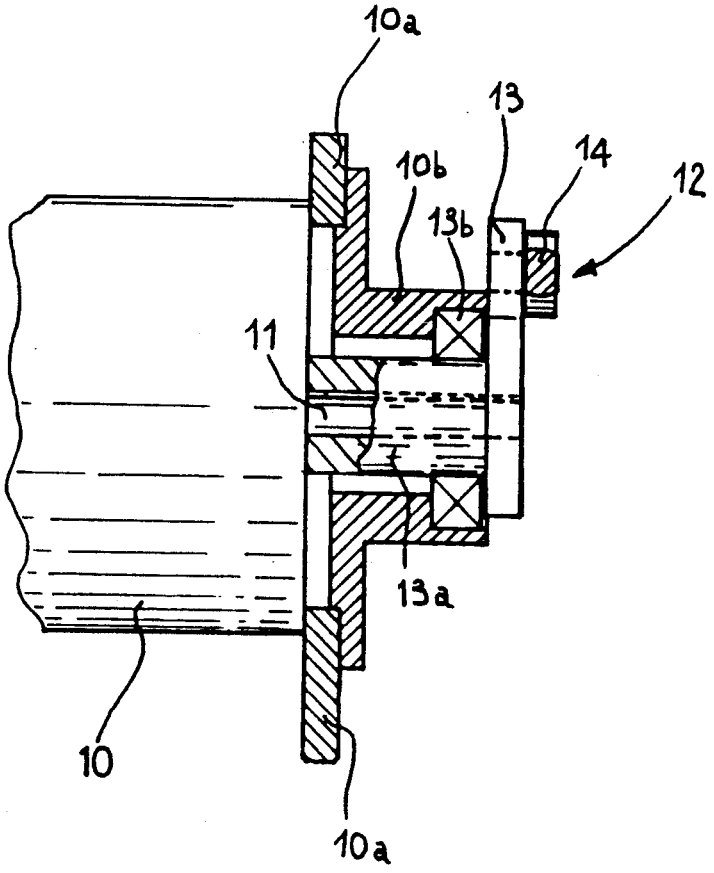
FIG. 4 is a partly sectional view to an enlarged scale taken along line IV—IV in FIG. 2.

Preferably the electronic control unit 35, only diagrammatically shown in FIG. 3, is mechanically separated from the knitting machine structure so that it is not subjected to undesired vibrations in operation.

The movement control of the individual tube bars 5 takes place based on the number of angular steps carried out by the individual drive shafts 11 in performing the angular oscillations imparted thereto by the stepping motors 10 upon command of the control unit 35.

In other words, each time it is necessary to transmit a given horizontal displacement to one of the tube bars 5, the control unit 35 causes the rotation of the corresponding drive shaft 11 according to a given number of angular steps corresponding to the desired displacement of the bar itself.

In greater detail, for the purpose of enabling control by the control unit 35, each displacement performed by the tube bar 5 is considered as built up of a plurality of horizontal-movement steps "P" each of which corresponds to a given number of angular steps performed by the drive shaft 11.

Each horizontal-movement step "P" preferably exhibiting a breadth corresponding to the distance between centers existing between two contiguous needles 9, is delimited between two limit points or end-of-stroke points, the threading tubes 8 each of which the threading tubes 8 corresponds a centered position of each threading tubes 8 with respect to the space defined between two of said consecutive side by side needles 9.

Therefore each displacement carried out in either way by the tube bar 5 will correspond to one or more movement steps depending upon the number of needles 9 that must be stepped over by the treading tubes 8. At all events, the stopping of each displacement of the tube bar 5 and the movement reversal thereof will take place at one of the limit points, in order to ensure the absence of interference between the needles 9 and threading tubes 8 at the moment said threading tubes 8 lower for insertion between the needles.

It is to be noted that, due to the inherent features of the connecting rod 14-crank 13 assembly there is no constancy in the proportionality between the measure of the individual angular steps performed by each drive shaft 11 and the corresponding displacements consequentially carried out by the tube bar 5. As a result, a different number of angular steps carried out by the drive shaft 11 will correspond to the different movement steps "P" included in the maximum displacement stroke carried out by each tube bar 5.

Figures 5, 6:
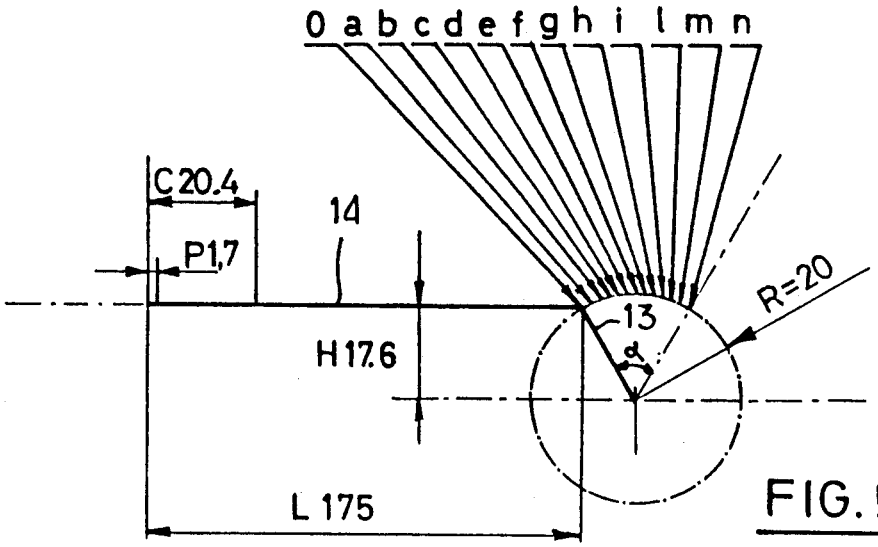
FIG. 5 shows, just as an indication, a diagram of a kinematic motion adopted for operation of a tube bar.
FIG. 6 is a table showing, just as an indication, the number of angular steps imparted to the motor drive shaft for achieving given shiftings of the tube bar.

For better understanding the above concept, FIGS. 5 and 6 respectively show, by way of example only, a kinematic diagram exhibiting the corresponding size features of the connecting rod 14-crank 13 assembly, and a table reproducing the number of the angular steps executed by the drive shaft 11 in order to achieve given movement steps "P" of the tube bar 5.

It is to be noted that in FIG. 5 references "L", "R", "H", "P", and "C" respectively denote the connecting rod 14 length, the crank 13 length, the distance between the trajectory performed by the connecting rod eye and the axis of the drive shaft 11, the horizontal-movement step of the single tube bar 5 and the maximum stroke obtainable by the tube bars.

Referring to FIG. 6, it is also to be noted that wordings "obtainable displacement" and "rated displacement" refer to the sum of movement steps included between position "0" and position "n".

It is pointed out that said figures refer to the use of stepping motors 10 having the following features:

stroke number: 4
angular step: 0.9°
tolerance in the angular step: ±0.09°
unipolar rated phase current: 4.6 A
phase resistance at 25° C: 0.55Ω±10%
phase inductance: 2.5 mH±20%
minimum step-holding torque (with two phases energized at the unipolar rated current): 211 Newton cm
moment of inertia of rotors: 1.12 kg $cm^2$
weight: 2.5 kg
insulation class: B From table in FIG. 6 it is possible to see that when the crank 13 is oriented according to positions close to the stroke limits of the tube bar 5 (positions 0, a,m,n), the number of angular steps necessary to achieve the movement step "P" of the tube bar, corresponding to a rated displacement of 1.7 mm, is higher than the number of angular steps necessary to achieve the same rated displacement when the orientation of the crank 13, in the central area of the stroke that the tube bar 5 can effect, is substantially at right angles to that of the connecting rod 14. It is also possible to note that the difference between the displacements obtainable in the tube bar 5 following the succession of angular steps and corresponding rated displacements is not higher than 0.04 mm and therefore falls within the predetermined tolerance limits.

Still in accordance with the present invention, preferably interlocked to the electronic control unit 35 is control means 34 enabling the amplitude of the displacements and more generally the oscillations imparted to the individual tube bars 5 through the stepping motors 10 to be checked. In greater detail, the control means 34 has the function of making the control unit 35 sure that during the normal operation of the knitting machine the tube bars 5 have stopped exactly at the foreseen position, as regards their end-of-stroke positions.

To this end, according to a preferred embodiment of the control means 34, the drive shaft 11 of each stepping motor 10 is fastened to at least one plate-like element 36 exhibiting a plurality of optical locators 37 distributed according to an arc concentric with the drive shaft. In the embodiment shown each of said optical locators 37 consists of a through hole formed in the plate-like element.

Each of the optical locators 37 represents one of the positions at which, depending on requirements, stopping of the tube bar 5 at the end of a horizontal displacement can occur. In the connection, each optical locator 37 is spaced apart from the adjacent optical locator by an amount of angular steps corresponding to the execution of the movement step "P".

At least a first photoelectric sensor 38 fastened to the supporting framework 2 acts on the plate-like element 36. The first photoelectric sensor 38 is arranged to detect and signal to the control unit 35, the passage of each optical locator 37 in front of a given first read point. In particular, the first photoelectric sensor 28 comprises a photoemitter and a photoreceiver disposed on the opposite sides of the plate-like element 36 and not shown as known per se.

When one of the through holes forming the optical locators 37 is in front of the first read point, the passage of light from the photoemitter to the photoreceiver proves that stopping of the corresponding tube bar 5 at the end of its stroke has occurred at the exact location, such that insertion of the threading tubes 8 between the needles 9 is ensured without any risks of mechanical interferences.

Preferably, also reproduced on the plate-like element 37 is at least one optical auxiliary locator 37*a* arranged to be identified at an auxiliary read point which is offset with respect to the first read point, by an auxiliary photoemitter and an auxiliary photoreceiver (not shown too), that in the embodiment shown are integrated in the structure of the first photoelectric sensor 38. The auxiliary optical locator 37*a* is intercepted by the auxiliary photoelectric sensor when the tube bar 5 is at a predetermined reference position which, in the case shown, is represented by its maximum excursion to the right. By adoption of the auxiliary optical locator 37*a*, the control unit 35 is capable of immediately identifying the maximum-excursion position of the individual tube bars 5 on the starting step of the knitting machine.

This position will be taken as a reference for the horizontal displacements to be subsequently transmitted to the individual tube bars 5.

Still in accordance with the present invention, also associated with each stepping motor 10 is stop means 18 responsive to a supply current of the knitting machine 3 and the device 1, in order to cause the immediate stoppage of movement of an corresponding tube bar 5 at a position coincident with any one of the limit points, should a cutoff of the supply current occur.

Thus all risks of mechanical interferences between the threading tubes 8 and needles 9 is eliminated even when, due to discontinuities or cutoffs in the supply current, the operation of said threading tubes and needles should not be synchronized any longer.

The stop means 18 preferably comprises at least one sector gear 19 operatively connected to the tube bar 5 and exhibiting a plurality of coupling housings 19*a* disposed consecutively in side by side relation according to a distance between centers of a measure corresponding to the horizontal-movement step of the tube bar. In greater detail, the sector gear 19 is fastened to a second end of the drive shaft 11 and substantially extends according to an arc of a circumference concentric with the drive shaft, the aperture of which corresponds to the maximum excursion that can be given to the horizontal movement of the tube bar 5. According to this solution the distance between centers existing between the coupling housings 19*a* is defined by an angular measure the aperture of which is equal to the sum of the angular steps that the drive shaft 11 must perform in order to achieve the displacement of the corresponding tube bar 5 according to a measure equal to the horizontal-movement step.

As clearly seen in FIG. 3, the coupling housings 19*a* preferably exhibit a wedge-shaped profile and are alternated with teeth 19*b* also having a wedge-shaped outline.

In combination with the sector gear 19 at least one centering and locking element 20 is provided, which preferably has a wedge-shaped profile the shape of which matches that of the coupling housings 19. This centering and locking element 20 is fastened to a support lever 21 oscillatably mounted to a frame 22 integral with the supporting framework 2.

The support lever 21 is movable about its own pivot axis between a release position in which the centering and locking element 20 is disengaged from the sector gear 19, to an engagement position in which the centering element is operatively fitted in one of the coupling housings 19*a*. The geometric configuration and relative positioning of the centering and locking element 20 and sector gear 19 are such that in the engagement position the drive shaft 11 is forced to keep an angular positioning enabling the positioning of the tube bar 5 to be fixed at any of the end of stroke positions, depending upon the positioning exhibited on the extension of the sector gear by the coupling housing 19*a* which is engaged by the centering and locking element.

In normal operation of the knitting machine, that is when it is correctly power supplied, the lever 21 is kept in the release position upon the action of at least one electromagnet 23 electrically connected to the feed line of the actuator device.

In greater detail, the magnet 23, fastened to the frame 22, acts on a ferromagnetic dish 24 oscillatably connected to the support lever 21, for example by means of a ball joint not shown as known per se and not of importance to the ends of the invention, in order to hold the lever in the release position against the action exerted by at least one return spring 25 acting between the support lever 21 and the frame 22. Should an electric cutoff occur to the knitting machine 4 and consequently to each actuator device 1, the electromagnet 23 would be immediately de-energized as a result of the lack of power. Under this situation the return spring 25 will bring the support lever 21 to the engagement position and, therefore, the centering and locking element 20 will automatically enter the coupling housing 19*a* being at the moment the closest thereto.

In this way each tube bar 5 is positioned and held at any one of the limit points along its movement stroke. Consequently, even if, due to the involved inertias, the vertical oscillatory movement of the tube bars and reciprocating movements of the needles and other members provided in the knitting machine goes on over a certain number of cycles starting from the moment the electric supply has ceased, the threading tubes 8 will be free to be vertically inserted between the needles 9 without any mechanical interference.

Obviously the stop means 18 may also be of the electronic type to be fed by electric batteries or capacitors or by utilizing the electric energy still present in the feed circuits of the actuator device 1 at the moments immediately following the power cutoff in the knitting machine.

In the embodiment shown restoring means 26 may be advantageously provided in order to bring the individual support levers 21 from the engagement position to the release position when the knitting machine 4 is actuated again.

Said restoring means 26 provides that at least one eccentric be substantially combined with each support lever 21, which eccentric is fitted on an actuator shaft 28 operable in angular rotation.

In the embodiment shown wherein motors 10 are disposed according to two opposite rows, a pair of this actuator shafts 28 is provided and the shafts are disposed parallelly to each other, each combined with one of the motor rows forming said "V" and supported by respective squares 28*a*.

Each of the eccentrics 27 fitted on the actuator shafts 28 lends itself to act on the corresponding support lever 21 through a locator element 29 extending in cantilevered fashion from the support lever, so as to cause the lifting of said lever from the engagement position to the release position, against the action of the return spring 25, following an angular rotation of the corresponding actuator shaft 28. Advantageously, the actuator shafts 28 are simultaneously operable to rotate by means of a knob 30 rotatably mounted to a bracket 30*a* fastened to the supporting framework 2 and carrying a rocker arm 31 the opposite ends of which are connected, through respective idler arms 32, to connecting arms 33 carried each by said shafts.

Therefore it will be sufficient to act manually on the knob 30 in order to simultaneously bring the support levers 21 of all actuator devices 1 to the release position.

The present invention attains the intended purposes.

In fact, by adopting the device in question instead of the traditional drive devices using glider chains, operations necessary for setting up the knitting machine for the execution of a given working are greatly facilitated. In particular, with reference to the device in question these operations exclusively involve the introduction into the control unit 35 of data concerning the sequence of movements to be imparted to the tube bars 5 in order to form a manufactured article having a given pattern or embroidery. The data sequence can be advantageously stored on magnetic discs or similar memory units, to be immediately used in case of need.

Provision may be also made for the control unit to be capable of reading data directly resulting from the execution of patterns on electronic processors such as AUTO-CAD and the like. Thus, as compared to the known art, it is possible to eliminate the necessity of translating patterns or embroideries to be executed on the manufactured articles into the corresponding sequences of cam elements necessary to obtain them.

In conclusion, the invention eliminates all problems resulting from the necessity of assembling the individual cam elements for the accomplishment of glider chains, as well as all expenses for the purchase and management in stock of said cam elements.

In addition, the great simplicity achieved in setting up the knitting machine makes it convenient to use said machine also for making small samplings of manufactured articles.

It is also pointed out that the device in reference, should a cutoff to the electric supply occur, enables the corresponding tube bar to be immediately stopped to such a position that any mechanical interference between the threading tubes and the needles of the knitting machine will be prevented.

Thus any risk of breakage of the threading tubes, needles and/or other members of the knitting machine is eliminated, should sudden cutoffs occur in the electric supply.

It will be recognized that the above cutoffs would involve heavy economical damages also due to the important amount of needles and threading tubes usually mounted to a knitting machine. In fact, it is necessary to take into account not only costs relating to the broken and/or damaged threading tubes and needles, but also costs resulting from the long times during which the machine is out of work because the damaged or broken parts need to be replaced and costs resulting from the time required for the new setting up.

Obviously the invention includes all changes and modifications which do not constitute a departure from the true scope of this invention as claimed in the following claims.

What is claimed is:

1. An actuator device for transmitting horizontal oscillatory movements to tube bars in knitting machines, said tube bars (5) being supported, at respective opposite ends thereof, by at least two lifting plates (6) slidably engaging the tube bars (5) in a horizontal direction, said device comprising:

a supporting framework (2) rigidly connected to a base (3) of said knitting machine (4);

a plurality of movement rods (15) each exhibiting one end (15*a*) operatively connected to one of the opposite ends of a corresponding tube bar (5);

drive means (10, 12) acting on a second end (15*b*) of each of said movement rods (15) for transmitting a horizontal oscillatory movement of variable amplitude to the corresponding tube bar (5), said horizontal oscillatory movement being combined with a vertical oscillatory movement imparted to the tube bars (5) through said lifting plates (6), in order to give a plurality of threading tubes (8) engaged to the tube bars (5) a reciprocating motion according to a arcuated path stepping over of respective needles (9);

disposed consecutively in side by side relation, so as to cause an interaction of weft yarns with warp yarns guided to the needles, wherein said drive means comprises:

a plurality of electric stepping motors (10) fastened to the supporting framework (2) and each arranged to impart to a respective drive shaft (11) angular rotations caused by a succession of angular steps of predetermined breadth;

a plurality of kinematic transmission mechanisms (12) each of which connects one of the movement rods (15) to the drive shaft (11) of one of said stepping motors (10), for transmitting a horizontal displacement to the corresponding tube bar (5) as a result of an angular rotation of the drive shaft itself;

at least one electronic control unit (35) controlling the actuation of the individual stepping motors (10)

in order to transmit the individual tube bars (5) horizontal oscillations each comprised of a plurality of horizontal-movement steps, each of said horizontal-movement steps corresponding to a predetermined number of said angular steps and being defined between two limit points each of which corresponds to a centered positioning of each threading tubes (8) with respect to a space defined between two of said needles (9);

stop means (18) responsive to a supply current of the knitting machine (4) and the actuator device (1), in order to cause an immediate movement stoppage of each tube bar (5) at a position coincident with one of said limit points when a cutoff of the electric supply occurs.

2. The device as claimed in claim 1, wherein interlocked to said electronic control unit (35) is control means (34) designed to check the amplitude of the oscillations transmitted to the individual tube bars (5) by the stepping motors (10).

3. The device as claimed in claim 2, wherein said control means (34) comprises, for each of said stepping motors (10): a plate-like element (36) rigidly connected to the drive shaft (11) of the respective stepping motor (10) and exhibiting a plurality of optical locators (37) distributed according to an arc concentric with the drive shaft (11), each of which is spaced apart from the adjacent optical locator (37) by an amount of angular steps corresponding to one of said movement steps; at least a first photoelectric sensor (38) fastened to the supporting framework (2) and acting on the plate-like element (36) in order to detect and signal to the control unit (35) the passage of the optical locators (37) in front of a predetermined first read point.

4. The device as claimed in claim 3, wherein at least one auxiliary optical locator (37*a*) is reproduced on said plate-like element (36), which auxiliary optical locator is identified by an auxiliary photoelectric sensor at an auxiliary read point which is offset with respect to the first read point when the corresponding tube bar (5) is at a predetermined reference position.

5. The device as claimed in claim 1, wherein each of said kinematic transmission mechanisms (12) comprises a connecting rod (14) operatively engaged to the second end of the corresponding movement rod (15), and a crank (13) integrally carried by the corresponding drive shaft (11) and operatively engaged to said connecting rod (14).

6. The device as claimed in claim 5, wherein each of said cranks (13) is fixedly fitted on the corresponding drive shaft (11) by a cylindrical sleeve (13*a*) which is rotatably engaged in a support collar (10*b*) rigidly connected to a support bracket (10*a*) secured to said framework (2) and rigidly engaging the corresponding stepping motor (10).

7. The device as claimed in claim 1, wherein said stepping motors (10) are distributed in a substantially horizontal plane according to two opposite rows defining a substantially V-shaped configuration the vertex of which is faced away from the tube bar (5).

8. The device as claimed in claim 1, wherein said stop means (18) comprises, for each tube bar (5):

at least one sector gear (19) operatively connected to the tube bar (5) and exhibiting a plurality of coupling housings (19*a*) disposed consecutively in side by side relation according to a distance between centers the measure of which corresponds to the horizontal-movement step ("P") of the tube bar;

at least one centering and locking element (20) fastened to a support lever (21) oscillatably connected to the supporting framework (2) and movable from a release position in which the centering and locking element (20) is disengaged from the sector gear (19) to an engagement position in which the centering and locking element (20) is operatively fitted in one of said coupling housings (19*a*) in order to retain the tube bar (5) in one of said limit points;

at least one electromagnet (23) rigidly connected to the supporting framework (2) and acting on the support lever (21) in order to hold said support lever in the release position;

at least one return spring (25) acting on the support lever (21) for bringing said support lever to the engagement position in the absence of electric supply to the electromagnet.

9. The device as claimed in claim 8, wherein said sector gear (19) is fastened to the drive shaft (11) of the stepping motor (10) and substantially extends according to an arc of a circumference concentric with the drive shaft.

10. The device as claimed in claim 8, wherein said coupling housings (19*a*) have a wedge-shaped profile.

11. The device as claimed in claim 8, wherein said coupling housings (19*a*) are alternated with respective teeth (19*b*) having a wedge-shaped profile.

12. The device as claimed in claim 8, wherein said centering and locking element (20) exhibits a wedge-shaped profile the shape of which matches the shape of the coupling housings (19*a*).

13. The device as claimed in claim 8, further comprising at least one ferromagnetic dish (24) oscillatably connected to the support lever (21) and arranged to act in contact with the electromagnet (23) when the support lever is in the release position.

14. The device as claimed in claim 8, further comprising restoring means (26) designed to bring the support levers (21) back from the engagement position to the release position.

15. The device as claimed in claim 14, wherein said restoring means (26) comprises at least one actuator shaft (28) operable in angular rotation and carrying at least one eccentric (27) arranged to act on the corresponding support lever (21) in order to move said support lever, against the action of said return spring (25), from the engagement position to the release position following the angular rotation of said actuator shaft (28).

16. The device as claimed in claim 15, wherein a pair of said actuator shafts (28) is provided, each shaft carrying a plurality of said eccentrics (27) which are each arranged to act on a corresponding support lever (21) associated with the stop means (18) interlocked to each of said stepping motors (10).

17. The device as claimed in claim 16, wherein said actuator shafts (28) can be simultaneously driven in rotation by a knob (30) rotatably engaged to said supporting framework (2) and carrying a rocker arm (31) the opposite ends of which are connected by respective idler arms (32) to connecting arms (33), each of which is carried by one of said actuator shafts (28).

* * * * *